US009905912B2

(12) United States Patent
Wu et al.

(10) Patent No.: US 9,905,912 B2
(45) Date of Patent: Feb. 27, 2018

(54) ANTENNA MODULE

(71) Applicant: PEGATRON CORPORATION, Taipei (TW)

(72) Inventors: Chien-Yi Wu, Taipei (TW); Cheng-Hsiung Wu, Taipei (TW); Chao-Hsu Wu, Taipei (TW); Shih-Keng Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 15/335,461

(22) Filed: Oct. 27, 2016

(65) Prior Publication Data

US 2017/0162932 A1 Jun. 8, 2017

(30) Foreign Application Priority Data

Dec. 3, 2015 (TW) ..... 104140521 A

(51) Int. Cl.

| | |
|---|---|
| ***H01Q 1/24*** | (2006.01) |
| ***H01Q 21/00*** | (2006.01) |
| ***H01Q 1/48*** | (2006.01) |
| ***H01Q 13/10*** | (2006.01) |

(52) U.S. Cl.

CPC ..... *H01Q 1/243* (2013.01); *H01Q 1/48* (2013.01); *H01Q 13/10* (2013.01); *H01Q 21/00* (2013.01)

(58) Field of Classification Search

CPC ..... H01Q 13/10; H01Q 1/243; H01Q 1/48; H01Q 21/00; H01Q 1/24

See application file for complete search history.

(56) References Cited

U.S. PATENT DOCUMENTS

| | | | | |
|---|---|---|---|---|
| 6,421,014 | B1 * | 7/2002 | Sanad | H01Q 1/243 343/700 MS |
| 6,639,560 | B1 * | 10/2003 | Kadambi | H01Q 1/243 343/700 MS |
| 6,707,428 | B2 * | 3/2004 | Gram | H01Q 1/243 343/700 MS |
| 7,099,690 | B2 * | 8/2006 | Milosavljevic | H01Q 1/243 343/702 |
| 8,547,283 | B2 | 10/2013 | Wong et al. | |

(Continued)

FOREIGN PATENT DOCUMENTS

| | | |
|---|---|---|
| TW | I487198 B | 6/2015 |

*Primary Examiner* — Tho G Phan

(74) *Attorney, Agent, or Firm* — CKC & Partners Co., Ltd.

(57) ABSTRACT

An antenna module includes a parasitic unit and a first antenna unit. The parasitic unit includes a first parasitic radiation portion and a second parasitic radiation portion. The second parasitic radiation portion is electrically connected to the first parasitic radiation portion. The first parasitic radiation portion and the second parasitic radiation portion surround a central area. The first antenna unit includes a feeding terminal, a ground terminal and a first radiation portion, in which the ground terminal is electrically connected to a ground portion. The feeding terminal is configured to transmit and receive a first antenna signal. The first radiation portion is configured to collaborate with the parasitic unit to generate a first resonant mode. The first resonant mode includes a central frequency, a frequency twice of the central frequency and a frequency three times of the central frequency.

10 Claims, 9 Drawing Sheets

(56) References Cited

U.S. PATENT DOCUMENTS

| | | | | |
|---|---|---|---|---|
| 8,749,448 | B2 * | 6/2014 | Tsou | H01Q 1/243<br>343/876 |
| 2009/0128419 | A1 * | 5/2009 | Tseng | H01Q 9/0442<br>343/700 MS |
| 2010/0060528 | A1 * | 3/2010 | Chiu | H01Q 1/243<br>343/700 MS |

* cited by examiner

ANTENNA MODULE

RELATED APPLICATIONS

This application claims priority to Taiwan Application Serial Number 104140521, filed Dec. 3, 2015, which is herein incorporated by reference.

BACKGROUND

Technical Field

The present invention relates to an antenna technology. More particularly, the present invention relates to a multi-frequency antenna module.

Description of Related Art

Recently, as wireless communication technology develops, electronic products in the market, such as notebooks, tablet computers, etc., transmit information by widely using the wireless communication technology.

However, as communication requirements increase, if an antenna in an electronic product is desired to be designed as a multi-frequency antenna, the antenna is likely to have a bandwidth deficiency problem at a low frequency and is hardly to cover the LTE 700 frequency band.

Therefore, those skilled in the art have been endeavoring to solve the bandwidth deficiency problem of the multi-frequency antenna at the low frequency.

SUMMARY

In order to improve a bandwidth of a multi-frequency antenna at a low frequency, the present disclosure provides an antenna module that includes a parasitic unit and a first antenna unit. The parasitic unit includes a parasitic radiation portion and a second parasitic radiation portion. The second parasitic radiation portion is electrically connected to the first parasitic radiation portion. The first parasitic radiation portion and the second parasitic radiation portion surround a central area of the parasitic unit. The first antenna unit includes a feeding terminal, a ground terminal and a first radiation portion. The ground terminal is electrically connected to a ground portion. The feeding terminal is configured to transmit and receive a first antenna signal. The first radiation portion is configured to collaborate with the parasitic unit to generate a first resonant mode of the antenna module. The first resonant mode includes a central frequency, a frequency twice of the central frequency and a frequency three times of the central frequency.

In sum, the present disclosure can generate the resonant modes to cover many types of frequency bands by a double open-loop structure formed by the antenna unit and the parasitic unit, and have broadband characteristic. Moreover, the antenna module of the present disclosure is applicable to the multi-input multi-output (MIMO) system with good isolation.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
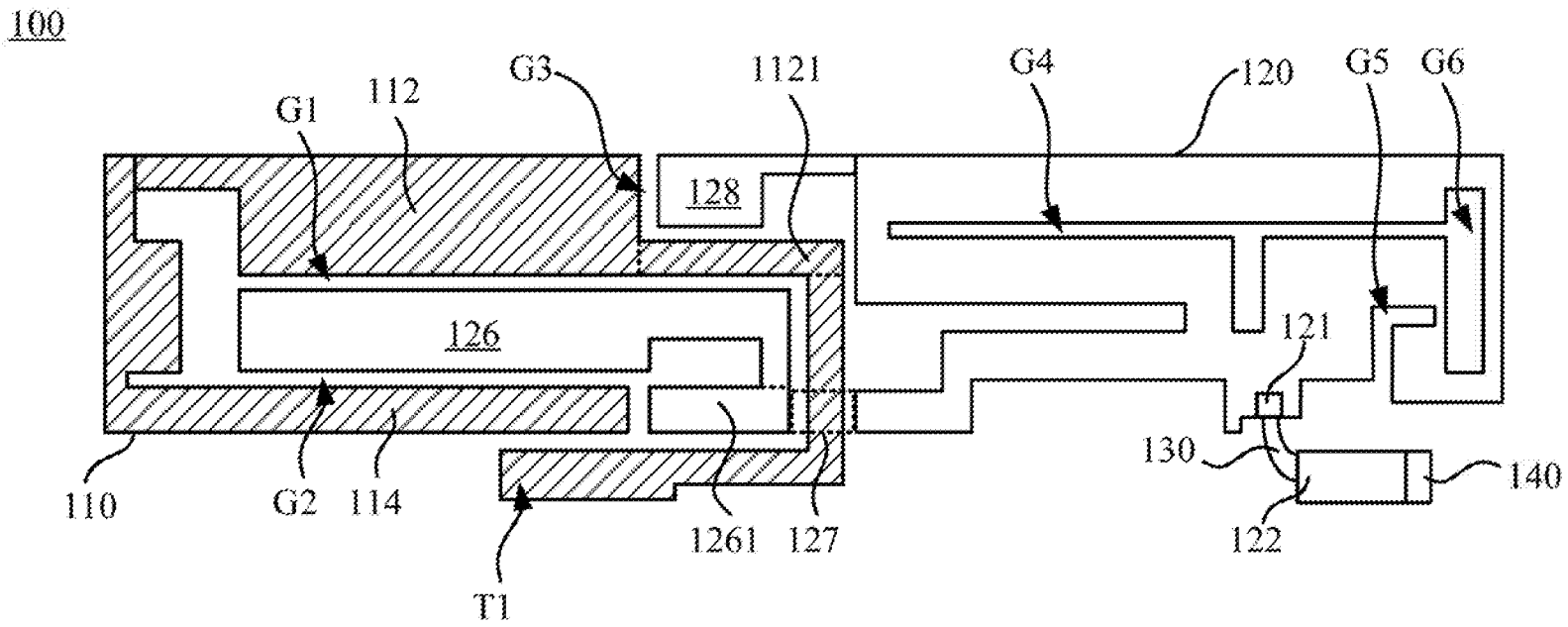
FIG. 1 is a schematic diagram of an antenna module according to an embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

In this document, the term "coupled" may also be termed as "electrically coupled," and the term "connected" may be termed as "electrically connected." "Coupled" and "connected" may also be used to indicate that two or more elements cooperate or interact with each other.

Unless otherwise indicated, all numbers expressing quantities, conditions, and the like in the instant disclosure and claims are to be understood as modified in all instances by the term "about." The term "about" refers, for example, to numerical values covering a range of plus or minus 20% of the numerical value. The term "about" preferably refers to numerical values covering range of plus or minus 10% (or most preferably, 5%) of the numerical value. The modifier "about" used in combination with a quantity is inclusive of the stated value.

Reference is made to FIG. 1. FIG. 1 is a schematic diagram of an antenna module 100 according to an embodiment of the present disclosure. As shown in FIG. 1, the antenna module 100 includes a parasitic unit 110 and an antenna unit 120. The parasitic unit 110 and the antenna unit 120 form a double open-loop structure.

Figure 2A:
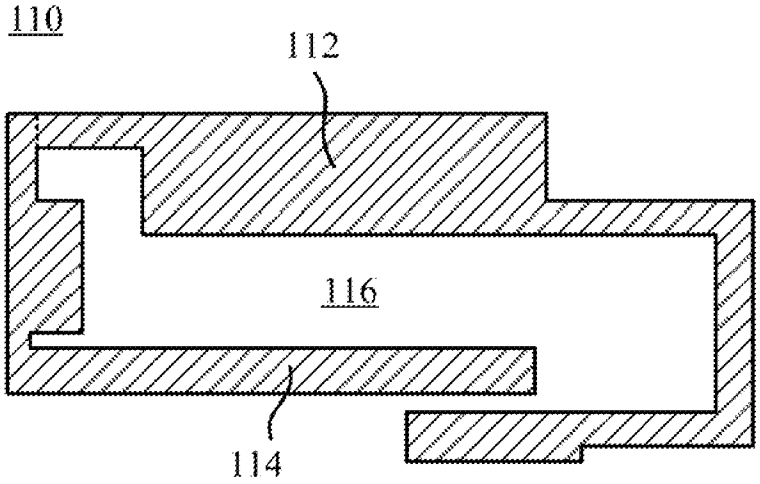
FIG. 2A is a schematic diagram of a parasitic unit of an antenna module according to an embodiment of the present disclosure.

In order to describe the parasitic unit 110, reference is made to FIG. 2A. The parasitic unit 110 includes a first parasitic radiation portion 112 and a second parasitic radiation portion 114, in which the first parasitic radiation portion 112 is electrically connected to the second parasitic radiation portion 114. An area surrounded by the first parasitic radiation portion 112 and the second parasitic radiation portion 114 is a central area 116 of the first parasitic unit 112.

Figure 2B:
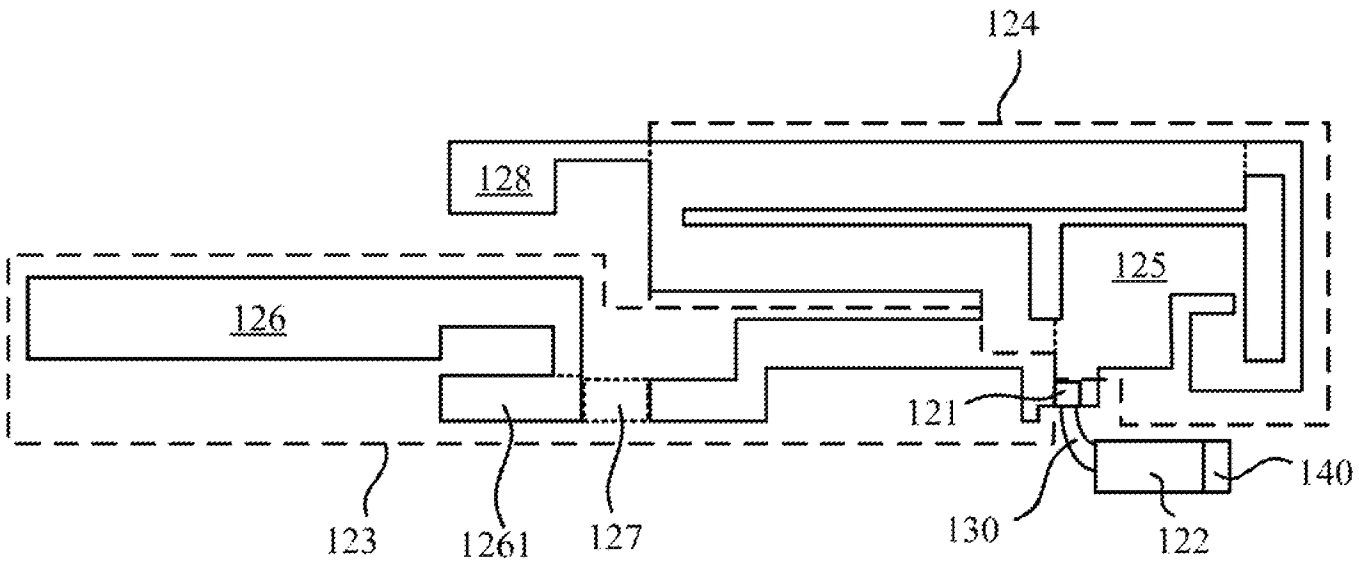
FIG. 2B is a schematic diagram of an antenna unit of an antenna module according to an embodiment of the present disclosure.

In order to describe the antenna unit 120, reference is made to FIG. 2B. The antenna unit 120 includes a feeding terminal 121, a ground terminal 122, a first radiation portion 123 and a connecting portion 127. The antenna unit 120 may be divided into a connecting portion 127 and a main body. The connecting portion 127 is disposed on a second surface of a substrate (e.g., a printed circuit board (PCB)), and is electrically connected to the main body on a first surface of the substrate. The feeding terminal 121 is configured to transmit and receive a first antenna signal. The ground terminal 122 is electrically connected to a ground portion 140. The ground portion 140 may be electrically connected to a ground of a system to which the antenna module 100 is applied, and the size of the ground portion 140 is determined in accordance with the system. In an embodiment, the first radiation portion 123 includes a first protruding portion 126. The first protruding portion 126 is disposed in the central area 116 of the parasitic unit 110, a slot G1 is disposed between the first parasitic radiation portion 112 and the first protruding portion 126, and a slot G2 is disposed between the second parasitic radiation portion 114 and the first protruding portion 126 (as shown in FIG. 1).

Figure 4A:
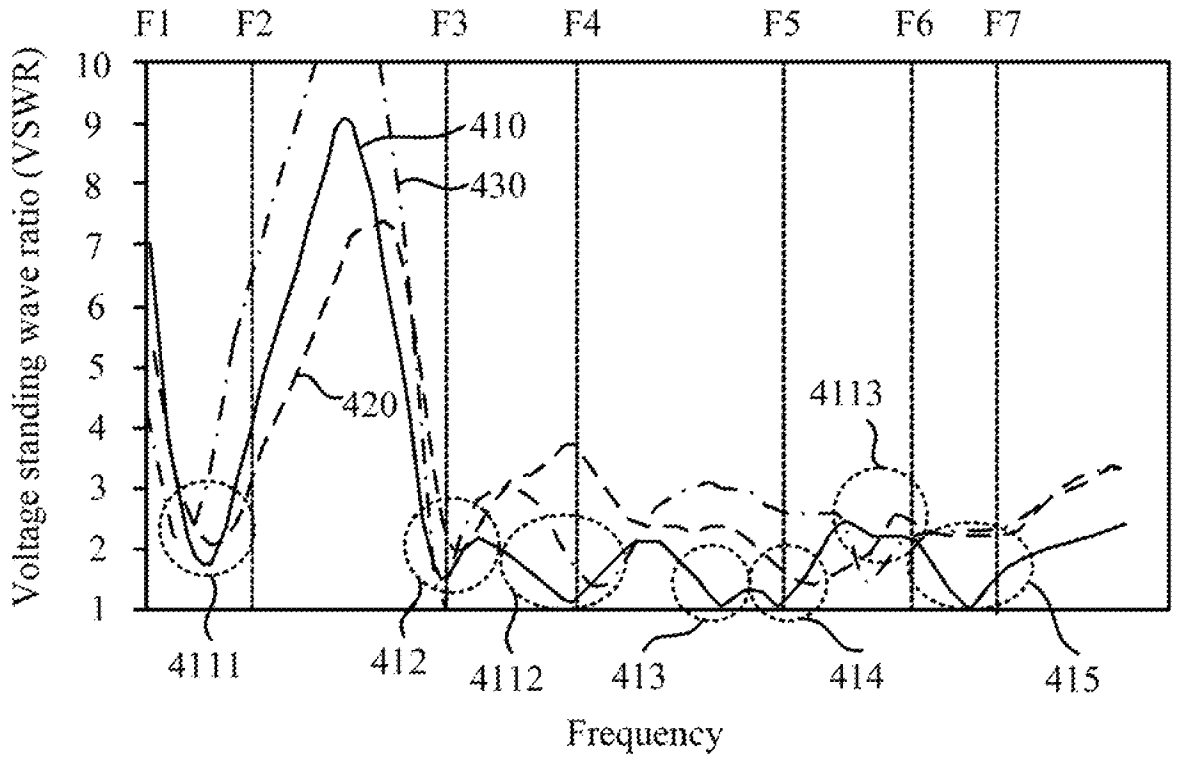
FIG. 4A is a schematic diagram showing a relationship between voltage standing wave ratio (VSWR) and frequency of an antenna module according to an embodiment of the present disclosure.

The first radiation portion 123 forms a monopole antenna, and is configured to collaborate with the parasitic unit 110 to generate a first resonant mode of the antenna module 100. Specifically, the parasitic unit 110 is electrically connected to the ground of the system to which the antenna module 100 is applied by a terminal T1. A positive terminal of a signal transmission line 130 is electrically coupled to the feeding terminal 121, and a negative terminal signal of the transmission line 130 is electrically coupled to the ground terminal 122. A signal is sent to the feeding terminal 121 through the positive terminal of the signal transmission line 130, passes through the first radiation portion 123, and is coupled with the parasitic unit 110 (including the first parasitic radiation portion 112 and the second parasitic radiation portion 114) through the slot G1 and the slot G2, so as to generate the first resonant mode. Frequency bands covered by the first resonant mode include a central frequency, a frequency twice of the central frequency and a frequency three times of the central frequency. In an embodiment, the central frequency is about 704-906 MHz, the frequency twice of the central frequency is about 1700 MHz, and the frequency three times of the central frequency is about 2400 MHz. As shown in FIG. 4A, a frequency band 4111 stands for 704-906 MHz, a frequency band 4112 stands for 1700 MHz, and a frequency band 4113 stands for 2400 MHz. The antenna module 100 can achieve only one resonant mode at a low frequency, i.e., the first resonant mode. Moreover, a user can adjust an impedance bandwidth of the antenna module 100 at the first resonant mode by designing a length and/or a width of a portion 1261 (included in the first protruding portion 126).

In an embodiment, a bandwidth of the frequency twice of the central frequency at the first resonant mode is about 1425 MHz-2170 MHz, which includes 1.5 GHz long term evolution (LTE) B11 and B21 frequency bands. A bandwidth of the frequency three times of the central frequency at the first resonant mode is about 2500 MHz-2700 MHz, which includes the LTE B7 frequency band.

In practice, the connecting portion 127 of the antenna unit 120 disposed on the second surface of the substrate may be electrically connected to the main body disposed on the first surface of the substrate through a via. As shown in FIG. 1, a projection area of the connecting portion 27 projected on the first surface of the substrate overlaps with a portion of the first parasitic radiation portion 112. Due to isolation by thickness (e.g., 4 mm) of the substrate, the connecting portion 127 is electrically isolated from the parasitic unit 110. The signal transmission line 130 may be a coaxial transmission line (e.g., a 50 ohm coaxial transmission line). However, the present disclosure is not limited thereto.

In an embodiment, the antenna module 100 is applicable to a mobile electronic device. For example, the electronic device may be a notebook, a cell phone, a tablet computer, a game machine, a translation machine, or any electronic device. However, the present disclosure is not limited thereto. The size of the antenna module 100 may be designed to a length of 75 mm, a width of 12 mm or 10 mm, and a thickness of 0.4 mm.

As a result, the antenna module 100 of the present disclosure can generate resonant modes that cover multi-frequencies through the design of the antenna unit 120 and the parasitic unit 110, and have broadband characteristic. Moreover, compared to the prior art, the antenna module 100 of the present disclosure does not need to set up an extending antenna path along a perpendicular (e.g., Z axis) direction, thus reducing antenna volume, further reducing the volume of the electronic device to which the antenna module 100 is applied.

In an embodiment, as shown in FIGS. 1 and 2B, the antenna unit 120 further includes a second radiation portion 124 and a second protruding portion 128. The second radiation portion 124 is electrically connected to the feeding terminal 121 and forms a monopole antenna. The second protruding portion 128 is electrically connected to the second radiation portion 124. A slot G3 is disposed between the second protruding portion 128 and the first parasitic radiation portion 112.

The second protruding portion 128 is configured to collaborate with the parasitic unit 110 to generate a second resonant mode of the antenna module 100. Specifically, a signal is sent to the feeding terminal 121 through the positive terminal of the signal transmission line 130, passes through the second radiation portion 124 and the second protruding portion 128, and is coupled with the parasitic unit 110 (including the first and second parasitic radiation portions 112 and 114) through the slot G3, so as to generate the second resonant mode. In an embodiment, a frequency band covered by the second resonant mode is about 1400 MHz, as shown by a frequency band 412 in FIG. 4A. Moreover, the user can adjust an impedance bandwidth of the second resonant mode by designing lengths and/or widths of the second protruding portion 128 and a portion 1121 (included in the first parasitic radiation portion 112).

In an embodiment, as shown in FIGS. 1 and 2B, the slot G4 is disposed in the second radiation portion 124. The second radiation portion 124 is configured to generate a third resonant mode of the antenna module 100. In an embodiment, a frequency band covered by the third resonant mode is about 2050 MHz, as shown by a frequency band 413 in FIG. 4A. Moreover, the user can adjust an impedance bandwidth of the third resonant mode by designing a length and/or a width of the slot G4.

In an embodiment, as shown in FIGS. 1 and 2B, the second radiation portion 124 includes a third protruding portion 125 that is electrically connected to the feeding terminal 121. A slot G5 is disposed in the third protruding portion 125. The third protruding portion 125 is configured to generate a fourth resonant mode of the antenna module 100. In an embodiment, a frequency band covered by the fourth resonant mode is about 2200 MHz, as shown by a frequency band 414 in FIG. 4A. Moreover, the user can adjust an impedance bandwidth of the fourth resonant mode by designing a length and/or a width of the slot G5.

In an embodiment, as shown in FIGS. 1 and 2B, a slot G6 is disposed in the third protruding portion 125. The third protruding portion 125 is configured to generate a fifth resonant mode of the antenna module 100. In an embodiment, a frequency band covered by the fifth resonant mode is about 2600 MHz, as shown by a frequency band 415 in FIG. 4A. Moreover, the user can adjust en impedance bandwidth of the fifth resonant mode by designing a length and/or a width of the slot G6.

For example, in the embodiment shown in FIG. 1, the frequency bands of the first resonant mode to the fifth resonant mode generated by the antenna module 100 cover the LTE 700 frequency band, the global system for mobile communications (GSM) 850 frequency band, the extended GSM 900 frequency band, the LTE 1500 frequency band, the digital cellular system (DCS) 1800 frequency band, the PCS 1900 frequency band, the universal mobile telecommunications system (UMTS) 2100 frequency band and the LTE 2500 frequency band. In other words, the antenna module 100 of the present disclosure covers many different types of frequency bands, and the user can adjust impedance bandwidths of the first resonant mode to the fifth resonant mode by designing lengths and/or widths of the slots G1-G6.

Figure 3:
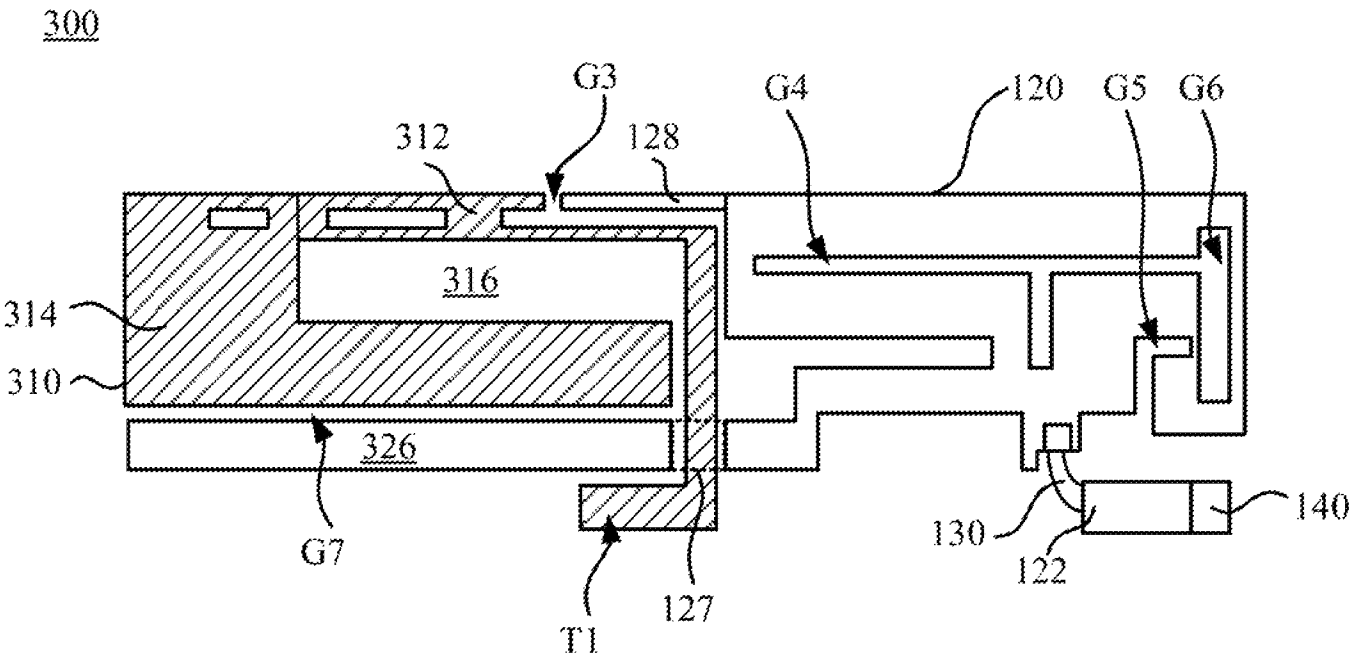
FIG. 3 is a schematic diagram of an antenna module according to an embodiment of the present disclosure.

In another embodiment, the aforementioned parasitic unit may be designed as different shapes, and the relative position to the antenna unit may be changed according to actual requirements. Reference is made to FIG. 3. An antenna module 300 is approximately the same as the antenna module 100, and the following description only focuses on the differences therebetween.

The antenna module 300 includes a parasitic unit 310 and an antenna unit 120. The parasitic unit 310 includes a first parasitic radiation portion 312 and a second parasitic radiation portion 314. The first parasitic radiation portion 312 is electrically connected to the second parasitic radiation portion 314. An area surrounded by the first parasitic radiation portion 312 and second parasitic radiation portion 314 is a central area 316. A first protruding portion 326 of the first radiation portion 123 is adjacent to the second parasitic radiation portion 314, and a slot G7 is disposed between the second parasitic radiation portion 314 and the first protruding portion 326.

Similarly, a signal is sent to the feeding terminal 121 through the positive terminal of the signal transmission line 130, passes through the first radiation portion 123, and is coupled with the parasitic unit 310 (including the first parasitic radiation portion 312 and the second parasitic radiation portion 314) through the slot G1, so as to generate a first resonant mode. Description about a second resonant mode to a fifth resonant mode of the antenna module 300 is similar to the above description, and are not repeated herein. The size of the antenna module 100 may be designed to a length of 75 mm, a width of 12 mm, and a thickness of 0.4 mm.

Figure 4B:
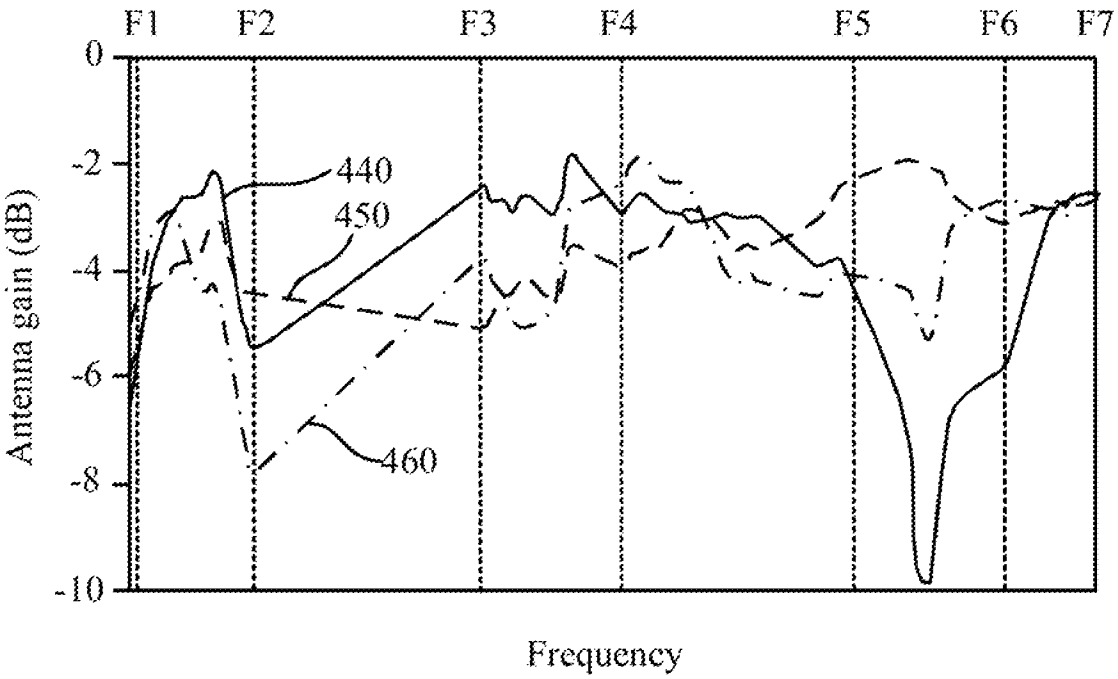
FIG. 4B is a schematic diagram showing a relationship between antenna gain and frequency of an antenna module according to an embodiment of the present disclosure.

Reference is made to FIGS. 4A and 4B. FIG. 4A is a schematic diagram showing a relationship between voltage standing wave ratio (VSWR) and frequency of an antenna module according to an embodiment of the present disclosure. As shown in FIG. 4A, a horizontal axis indicates frequency, and a longitudinal axis indicates VSWR, in which frequency F1 is about 704 MHz, frequency F2 is about 960 MHz, frequency F3 is about 1425 MHz, frequency F4 is about 1710 MHz, frequency F5 is about 2170 MHz, frequency F6 is about 2500 MHz, and frequency F7 is about 2700 MHz. FIG. 4B is a schematic diagram showing a relationship between antenna gain (unit: dB) and frequency of an antenna module according to an embodiment of the present disclosure. Curves 410 and 440 stand for the antenna module 100 with length of 75 mm, width of 12 mm and thickness of 0.4 mm. Curves 420 and 450 stand for the antenna module 300 with length of 75 mm, width of 12 mm, and thickness of 0.4 mm. Curves 430 and 460 stand for the antenna module 100 with length of 75 mm, width of 10 mm, and thickness of 0.4 mm. As shown in FIG. 4B, the antenna gain of the curve 460 is slightly smaller than the antenna gain of the curves 440 and 450 in a low frequency ranging 894 MHz-960 MHz, but other frequency bands have good antenna gains.

Figure 5:
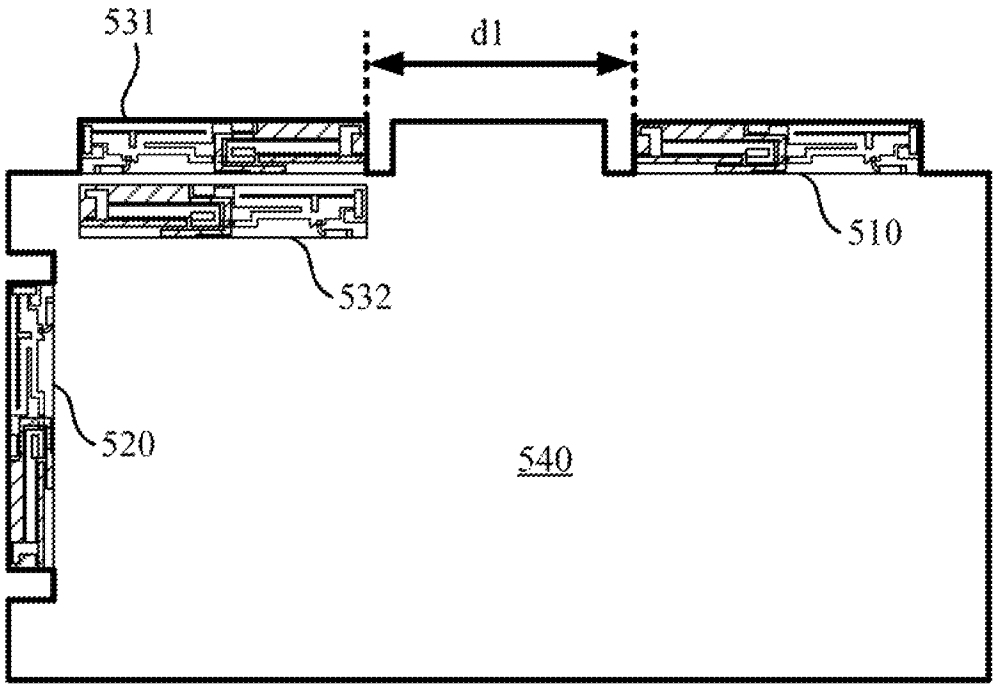
FIG. 5 is a schematic diagram of an antenna module applied to a multi-input multi-output (MIMO) system according to an embodiment of the present disclosure.

In an embodiment, the antenna modules 100 and 300 may be applicable to a multi-input multi-output (MIMO) communication system, and is disposed in a mobile electronic device. For example, the antenna module may be disposed in a tablet computer. As shown in FIG. 5, a first antenna module 510, a second antenna module 520, a third antenna module 531 and a fourth antenna module 532 may commonly share a ground 540 of the system. In a mobile electronic device with two antenna modules, the antenna modules may be placed at the positions of the first antenna module 510 and the second antenna module 520 those of the first antenna module 510 and third antenna module 531, or those of first antenna module 510 and the fourth antenna module 532. In a situation that the antenna modules at the first antenna module 510 and the third antenna module 531 and a situation that the antenna modules at the first antenna module 510 and the fourth antenna module 532, the first antenna module 510 is spaced from the third antenna module 531 (or the fourth antenna module 532) at least at a distance d1 (e.g., 75 mm). In an embodiment, an electronic device with size of more than 12 inches uses an arrangement of the first antenna module 510 and the second antenna module 520, and an electronic device with size of less than 12 inches uses an arrangement of the first antenna module 510 and the third antenna module 531 (or an arrangement of the first antenna module 510 and the fourth antenna module 532). However the present disclosure is not limited thereto.

Figure 6:
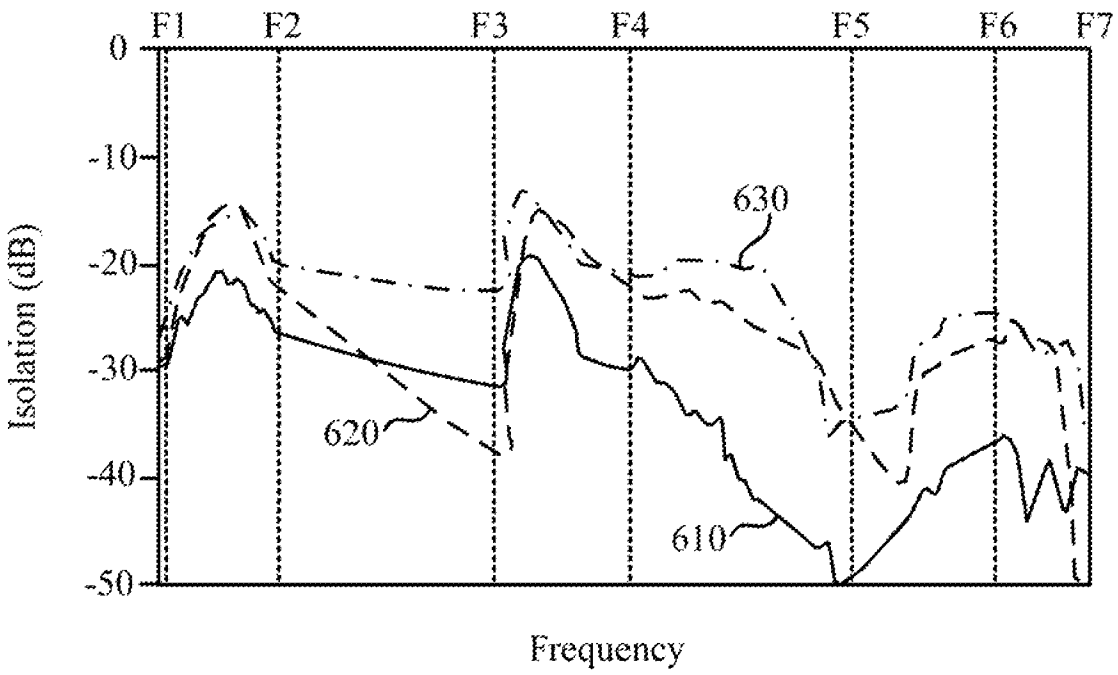
FIG. 6 is a schematic diagram showing a relationship between isolation and frequency of an antenna module applied to a MIMO system according to an embodiment of the present disclosure.

Reference is made to FIG. 6. FIG. 6 is a schematic diagram showing a relationship between isolation and frequency of an antenna module applied to a MIMO system according to an embodiment of the present disclosure. As shown in FIG. 6, a horizontal axis indicates frequency, a longitudinal axis indicates isolation (unit: dB), in which frequency F1 is about 704 MHz, frequency F2 is about 960 MHz, frequency F3 is about 1425 MHz, frequency F4 is about 1710 MHz, frequency F5 is about 2170 MHz, frequency F6 is about 約爲 2500 MHz and frequency F7 is about 2700 MHz. A curve 61 stands for the first antenna module 510 and the second antenna module 520, a curve 620 stands for the first antenna module 510 and the third antenna module 531, and a curve 630 stands for the first antenna module 510 and the fourth antenna module 532. From FIG. 6, curves 610-630 can achieve an isolation effect that is less than 13 dB, and an envelope correlation coefficient (ECC)

are less than 0.3, and therefore the interference between the antenna modules of the present disclosure is reduced.

Figure 7:
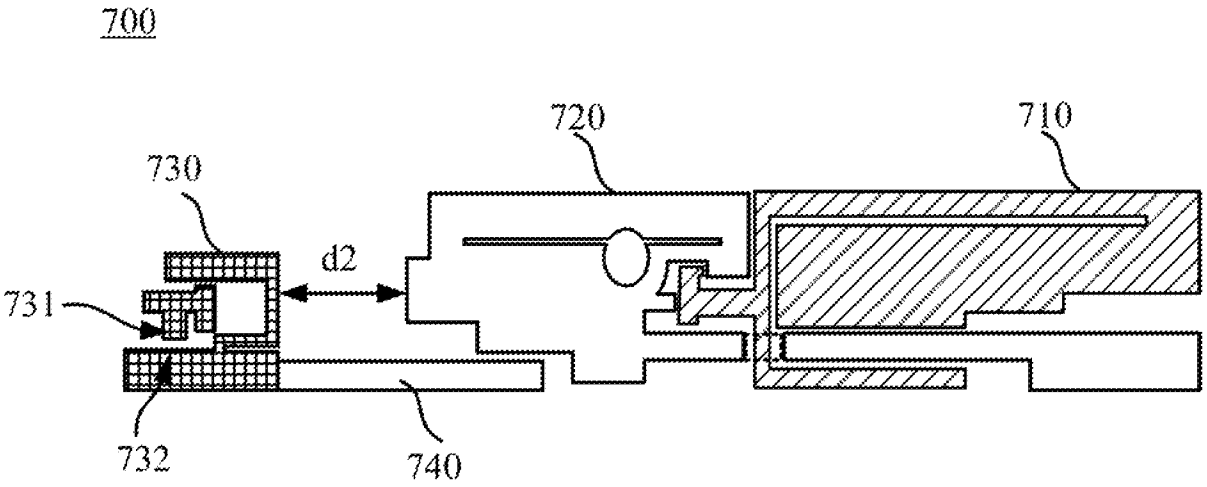
FIG. 7 is a schematic diagram of an antenna module according to an embodiment of the present disclosure.

In another embodiment, as shown in FIG. 7, an antenna module 700 is applied to a notebook, and the size of the antenna module 700 is designed to a length of 106 mm, a width of 16 mm and a thickness of 2.8 mm. The antenna module 700 includes a parasitic unit 710, an antenna unit 720 and an antenna unit 730. The parasitic unit 710 and the antenna unit 720 are respectively similar to the aforementioned parasitic units 110 and 310 and the antenna unit 120, and thus are not described again herein. A main body of the antenna unit 730 is spaced from a main body of the antenna unit 720 at least at a distance d2 (e.g., 13 mm), and the main body of the antenna unit 730 and the main body of the antenna unit 720 commonly share a ground portion 740.

A ground terminal 732 of the antenna unit 730 is electrically connected to the ground portion 740, and a feeding terminal 731 of the antenna unit 730 is configured to transmit and receive a second antenna signal. In an embodiment, the antenna unit 730 is configured to generate a sixth resonant mode that covers the wireless fidelity (Wi-Fi) frequency band. As a result, different antenna units may be integrated into the antenna module 700 of the present disclosure antenna to further reduce the antenna volume in the electronic device, and then to reduce the volume of the electronic device.

Through the above embodiments, the present disclosure can generate the resonant modes to cover many types of frequency bands by the double open-loop structure formed by the antenna unit and the parasitic unit, and have broadband characteristic. Moreover, the antenna module of the present disclosure can be applied to the MIMO system with good isolation.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An antenna module, comprising:

a parasitic unit, electrically connected to a ground portion, wherein the parasitic unit comprises:

a first parasitic radiation portion; and a second parasitic radiation portion, electrically connected to the first parasitic radiation portion, wherein the first parasitic radiation portion and the second parasitic radiation portion surround a central area of the parasitic unit; and a first antenna unit, comprising:

a feeding terminal, configured to transmit and receive first antenna signal;

a ground terminal, electrically connected to the ground portion; and a first radiation portion, electrically connected to the feeding terminal, wherein the first radiation portion is configured to collaborate with the parasitic unit to generate a first resonant mode of the antenna module, and the first resonant mode comprises a central frequency, a frequency twice of the central frequency and a frequency three times of the central frequency.

2. The antenna module of claim 1, wherein a first protruding portion of the first radiation portion is disposed in the central area, a first slot is disposed between the first parasitic radiation portion and the first protruding portion, and a second slot is disposed between the second parasitic radiation portion and the first protruding portion.

3. The antenna module of claim 1, wherein a first protruding portion of the first radiation portion is adjacent to the second parasitic radiation portion, and a first slot is disposed between the second parasitic radiation portion and the first protruding portion.

4. The antenna module of claim 1, wherein the first antenna unit comprises a connecting portion and a main body; the ground portion, the parasitic unit and the main body are disposed on a first surface of a substrate; the connecting portion is disposed on a second surface of the substrate and electrically connected to the first protruding portion; and a projection area of the connecting portion overlaps with the first parasitic radiation portion.

5. The antenna module of claim 1, wherein the first antenna unit further comprises:

a second radiation portion electrically connected to the feeding terminal; and a second protruding portion electrically connected to the second radiation portion and configured to collaborate with the parasitic unit to generate a second resonant mode of the antenna module, wherein a third slot is disposed between the second protruding portion and the first parasitic radiation portion.

6. The antenna module of claim 5, wherein a fourth slot is disposed in the second radiation portion, and the second radiation portion is configured to generate a third resonant mode of the antenna module and adjust an impedance bandwidth of the antenna module at the third resonant mode through the fourth slot.

7. The antenna module of claim 5, wherein the second radiation portion comprising:

a third protruding portion electrically connected to the feeding terminal, wherein a fifth slot is disposed in the third protruding portion, and the third protruding portion is configured to generate a fourth resonant mode of the antenna module and adjust an impedance bandwidth of the antenna module at the fourth resonant mode through the fifth slot.

8. The antenna module of claim 7, wherein a sixth slot is disposed in the third protruding portion and configured to generate a fifth resonant mode of the antenna module and adjust an impedance bandwidth of the antenna module at the fifth resonant mode through the sixth slot.

9. The antenna module of claim 1, wherein the antenna module further comprising:

a second antenna unit configured to generate a sixth resonant mode, wherein a main body of the second antenna unit is at a distance from a main body of the first antenna unit, a ground terminal of the second antenna unit is electrically connected to the ground portion, and a feeding terminal of the second antenna unit is configured to transmit and receive a second antenna signal.

10. The antenna module of claim 1, wherein the antenna module is included in a mobile electronic device.

* * * * *